US009274467B2

(12) United States Patent
Takeuchi et al.

(10) Patent No.: US 9,274,467 B2
(45) Date of Patent: Mar. 1, 2016

(54) IMAGE HEATING APPARATUS

(75) Inventors: Suguru Takeuchi, Toride (JP); Tatsuhito Watanabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 989 days.

(21) Appl. No.: 13/422,232

(22) Filed: Mar. 16, 2012

(65) Prior Publication Data

US 2012/0248097 A1 Oct. 4, 2012

(30) Foreign Application Priority Data

Mar. 29, 2011 (JP) ..... 2011-071783

(51) Int. Cl.
*H05B 6/10* (2006.01)
*G03G 15/20* (2006.01)

(52) U.S. Cl.
CPC ..... *G03G 15/2053* (2013.01)

(58) Field of Classification Search
CPC ..... G03G 15/2007; G03G 15/206; G03G 15/5004; G03G 15/2053; G03G 15/2003; H05B 6/145; H05B 6/06
USPC ..... 219/619, 216, 490, 665; 399/328–335, 399/327, 67, 69, 70, 45, 94; 430/124
See application file for complete search history.

(56) References Cited

U.S. PATENT DOCUMENTS

| | | | |
|---|---|---|---|
| 5,552,582 | A | 9/1996 | Abe et al. |
| 2005/0173415 | A1 | 8/2005 | Yamamoto et al. |
| 2005/0254866 | A1 | 11/2005 | Obata et al. |
| 2009/0285609 | A1 | 11/2009 | Hayashi |
| 2010/0150621 | A1 | 6/2010 | Sugaya |
| 2010/0178088 | A1 | 7/2010 | Koshida et al. |
| 2014/0064786 | A1* | 3/2014 | Mogi ..... 399/122 |

FOREIGN PATENT DOCUMENTS

| | | | |
|---|---|---|---|
| CN | 1064144 | C | 4/2001 |
| JP | 08-6409 | A | 1/1996 |
| JP | 08-16005 | A | 1/1996 |
| JP | 2004-311154 | A | 11/2004 |
| JP | 2009-301019 | A | 12/2009 |
| JP | 2010-145592 | A | 7/2010 |
| JP | 2010-160388 | A | 7/2010 |

OTHER PUBLICATIONS

Chinese Office Action issued in Corresponding Chinese Application No. 201210088240.2 dated Sep. 2, 2014.

* cited by examiner

*Primary Examiner* — Quang Van
(74) *Attorney, Agent, or Firm* — Fitzpatrick, Cella, Harper & Scinto

(57) ABSTRACT

An image heating apparatus includes a coil; a belt member; a first core and a second core which are provided inside the belt member; a contact member contacting an inner surface of the belt member along a widthwise direction of the belt member; a pressing member configured to press the belt member against the contact member; a core supporting member configured to support the first and second cores; a pressing mechanism configured to generate pressure for forming a nip; and an adjusting portion, provided on the core supporting member, configured to adjust the height of each of the first core and the second core so that the height of a supporting surface configured to support the first core and the height of a supporting surface for supporting the second core are different from each other with respect to a direction perpendicular to the supporting surfaces.

5 Claims, 9 Drawing Sheets

(a) PRESSING MECHANISM (b) INNER MAGNETIC CORE

IMAGE HEATING APPARATUS

FIELD OF THE INVENTION AND RELATED ART

The present invention relates to an image heating apparatus in which a heating nip for a recording material is formed by a rotatable pressing member and a belt member which is induction-heated by magnetic flux generated by a coil member opposing an outer peripheral surface of the belt member. Specifically, the present invention relates to a supporting structure for supporting a plurality of cores provided inside the belt member.

As the image heating apparatus, that of a belt-heating type in which the heating nip for the recording material is formed by bringing the rotatable pressing member into contact with the outer surface of the belt member supported at the inner surface by supporting members has been put into practical use. In the image heating apparatus of the belt heating type, as shown in FIGS. 2 and 4, the heating nip (N) for the recording material is formed between the belt member (1) and the rotatable pressing member (2) by bringing the rotatable pressing member (2) into press-contact with the outer peripheral surface of the belt member (1) supported at the inner surface by the supporting members (3, 4). The image heating apparatus of the belt-heating type has, compared with a conventional image heating apparatus of a roller-heating type, features such as electric power saving and quick temperature rising.

In Japanese Laid-Open Patent Application (JP-A) 2004-311154, a fixing device is shown in which a coil member including an outer core of a magnetic material is disposed opposed to the inner surface of a belt member provided with a metal layer, and the belt member passing through the heating nip is induction-heated from the inside thereof. In this fixing device, in order to flatten the temperature distribution in the heating nip with respect to a rotational axis direction of the belt member, the length in direction of diameter of a plurality of magnetic cores divided along the rotational axis direction is gradually lengthen from a central side toward an outer side.

In JP-A 2009-301019, a fixing device in which a coil member is disposed opposed to the outer peripheral surface of a belt member provided with a metal layer and an inner core of a magnetic material is disposed correspondingly to the coil member at an inner peripheral surface side of the belt member so as to externally induction-heat the belt member at a side opposite from the heating nip is shown. The inner core shields the magnetic flux generated by the coil member to avoid unnecessary heat generation of the member of the metal material disposed inside the belt member and also forms a magnetic circuit of the magnetic flux, generated by the coil member, inside the coil member to increase the magnetic flux which penetrates through the belt member.

With respect to the image heating apparatus of the belt-heating type in which the induction heating is effected, as shown in JP-A 2004-311154, compared with a central side, the temperature at both end portions is liable to lower, and therefore the coil member and the inner core are designed so as to increase the amount of heat generation at the both end portions.

However, it was turned out that even in the case where the coil member and the inner core are designed so that a predetermined target temperature distribution can be obtained with respect to the rotational axis direction by specific nip pressure by the belt member and the rotatable pressing member, when the nip pressure is changed, the temperature distribution is changed, and thus heating non-uniformity occurs to lower the quality of an output image. For this reason, there is a need to use a different coil member and inner core for every image heating apparatus with a different nip pressure.

Therefore, as shown in JP-A 2010-160388, flattening of the temperature distribution by dividing a core (outer core) of the coil member into plural core portions and then by individually moving the core portions relative to the inner core in a contact-and-separation direction to adjust an opposing distance has been proposed. However, in this case, as shown in JP-A 2010-160388, the mechanism becomes complicated and it is difficult to effect control for individually adjusting the opposing distance. For that reason, it has been desired that the distance between the core and the belt be adjusted with a simple constitution.

SUMMARY OF THE INVENTION

A principal object of the present invention is to provide an image heating apparatus capable of optimizing a temperature distribution of a belt with a simple constitution.

According to an aspect of the present invention, there is provided an image heating apparatus comprising: a coil for generating magnetic flux; a belt member for generating heat by the magnetic flux, wherein the coil is provided at a position where the coil opposes an outer peripheral surface of the belt member; a first core and a second core which are provided inside the belt member; a contact member contacting an inner surface of the belt member along a widthwise direction of the belt member; a pressing member for pressing the belt member against the contact member to form a nip in which a recording material is nip-conveyed; a core supporting member for supporting the first one and the second core; a pressing mechanism for generating pressure for forming the nip by using a force generated between the core supporting member and the contact member; and adjusting means, provided on the core supporting member, for adjusting the height of each of the first core and the second core so that the height of a supporting surface for supporting the first core and the height of a supporting surface for supporting the second core are different from each other with respect to a direction perpendicular to the supporting surfaces.

These and other objects, features and advantages of the present invention will become more apparent upon a consideration of the following description of the preferred embodiments of the present invention taken in conjunction with the accompanying drawings.

Figure 4:
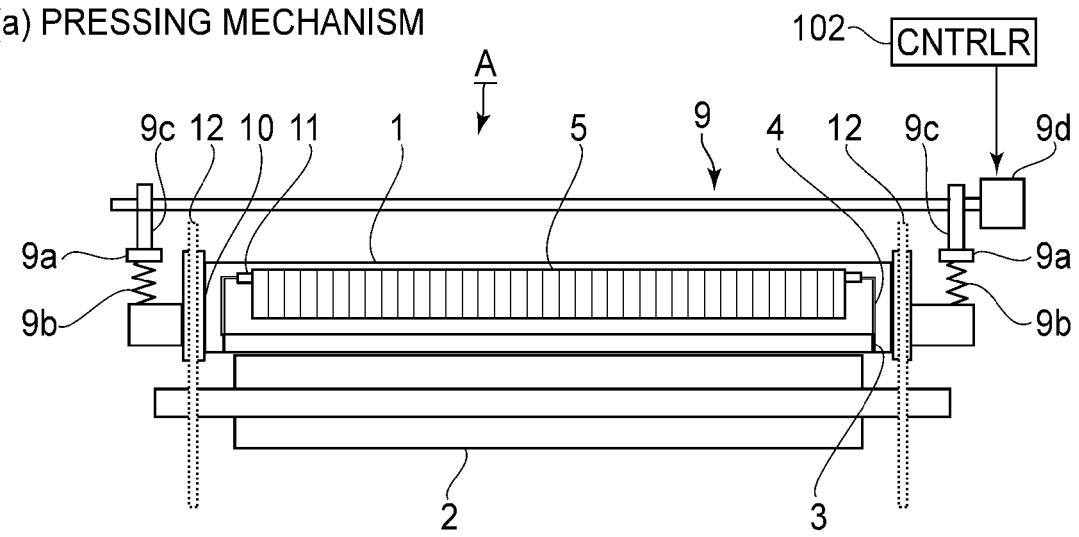
Figure 4:
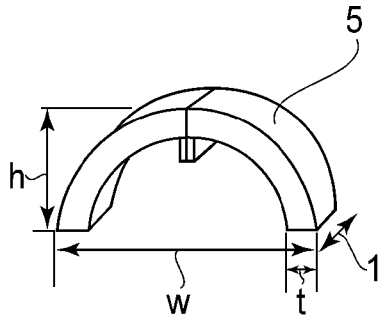

Part (a) of FIG. 4 is an illustration of a structure of the fixing device with respect to a longitudinal direction, and (b) of FIG. 4 is a perspective view of an inner magnetic core.

Figure 5:
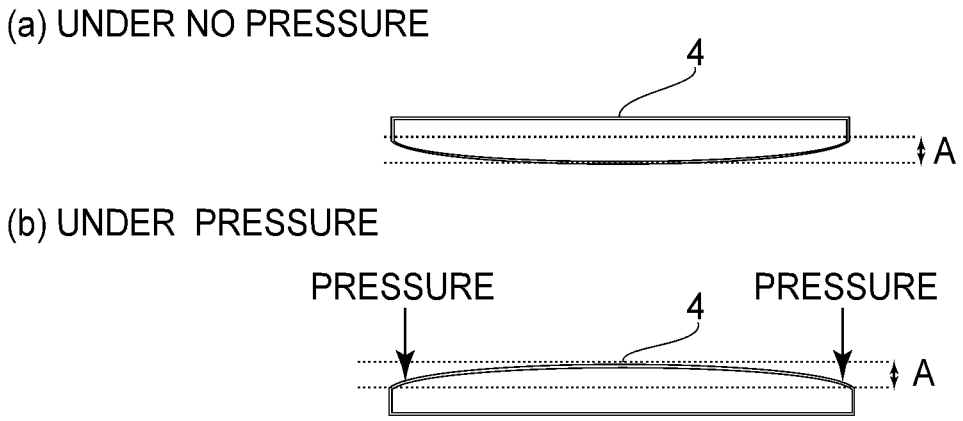

Parts (a) and (b) of FIG. 5 are illustrations of a crown-shaped stay.

Figure 6:
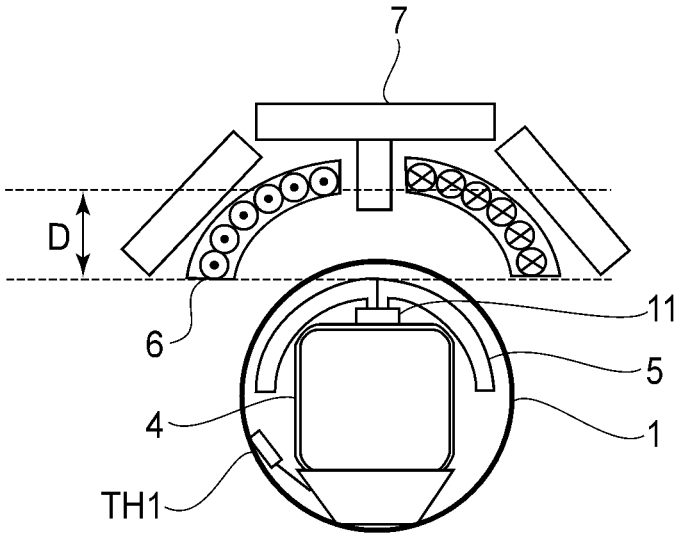

FIG. 6 is an illustration of a distance between an exciting coil and the inner magnetic core.

Figure 7:
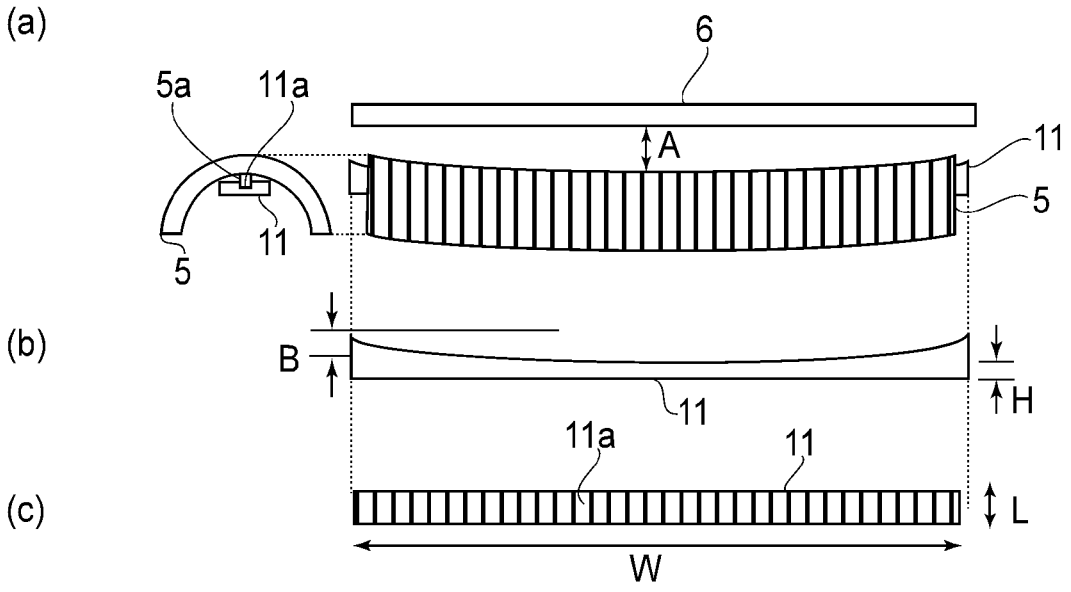

Parts (a) to (c) of FIG. 7 are illustrations of a structure of a spacer in Embodiment 1.

Figure 8:
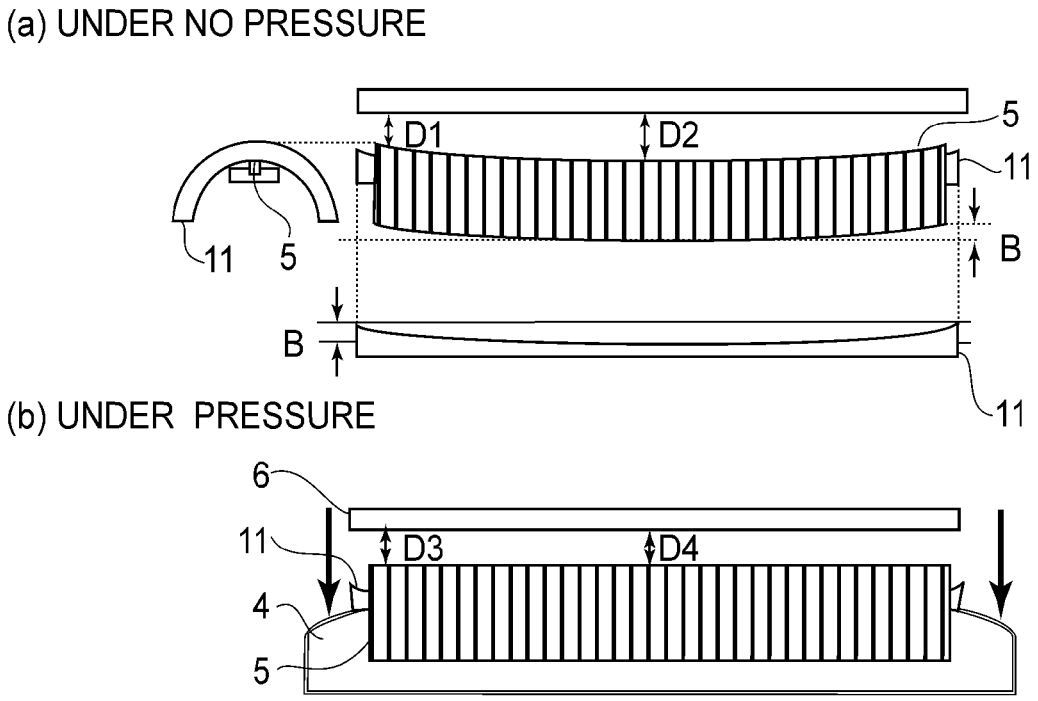

Parts (a) and (b) of FIG. 8 are illustrations of a change in distance between the inner magnetic core and another magnetic core under no pressure application and under pressure application, respectively.

Figure 9:
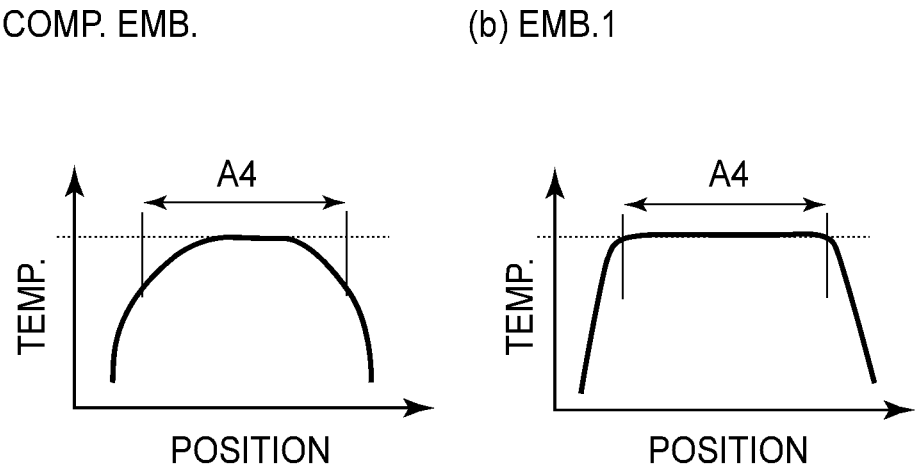

Parts (a) and (b) of FIG. 9 are illustrations of an effect of Embodiment 1.

Figure 10:
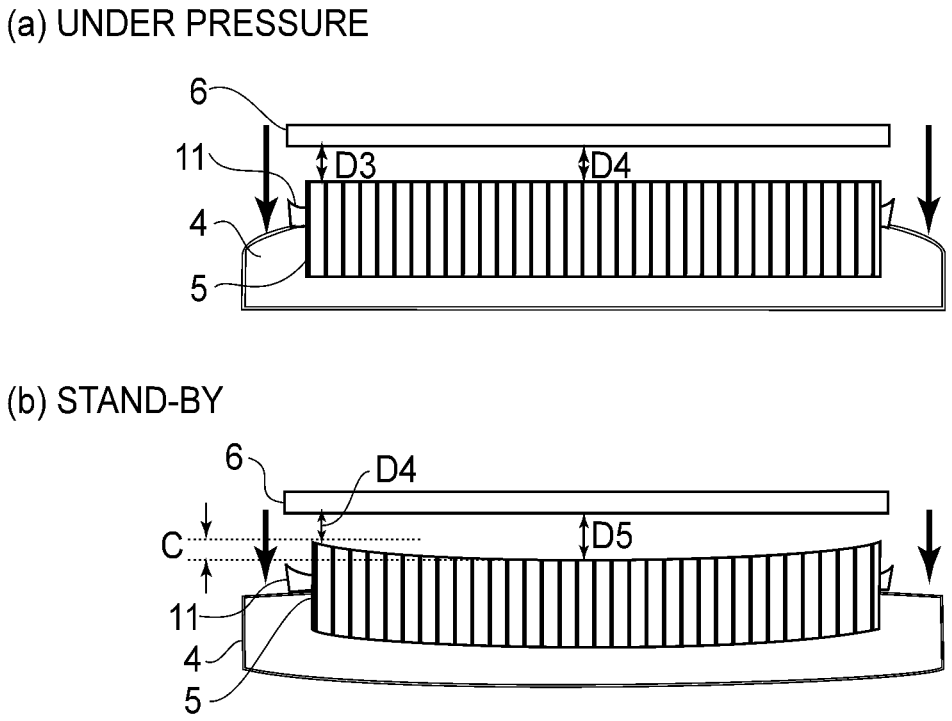

Parts (a) and (b) of FIG. 10 are illustrations during image formation (pressure application) and during stand-by, respectively.

Figure 11:
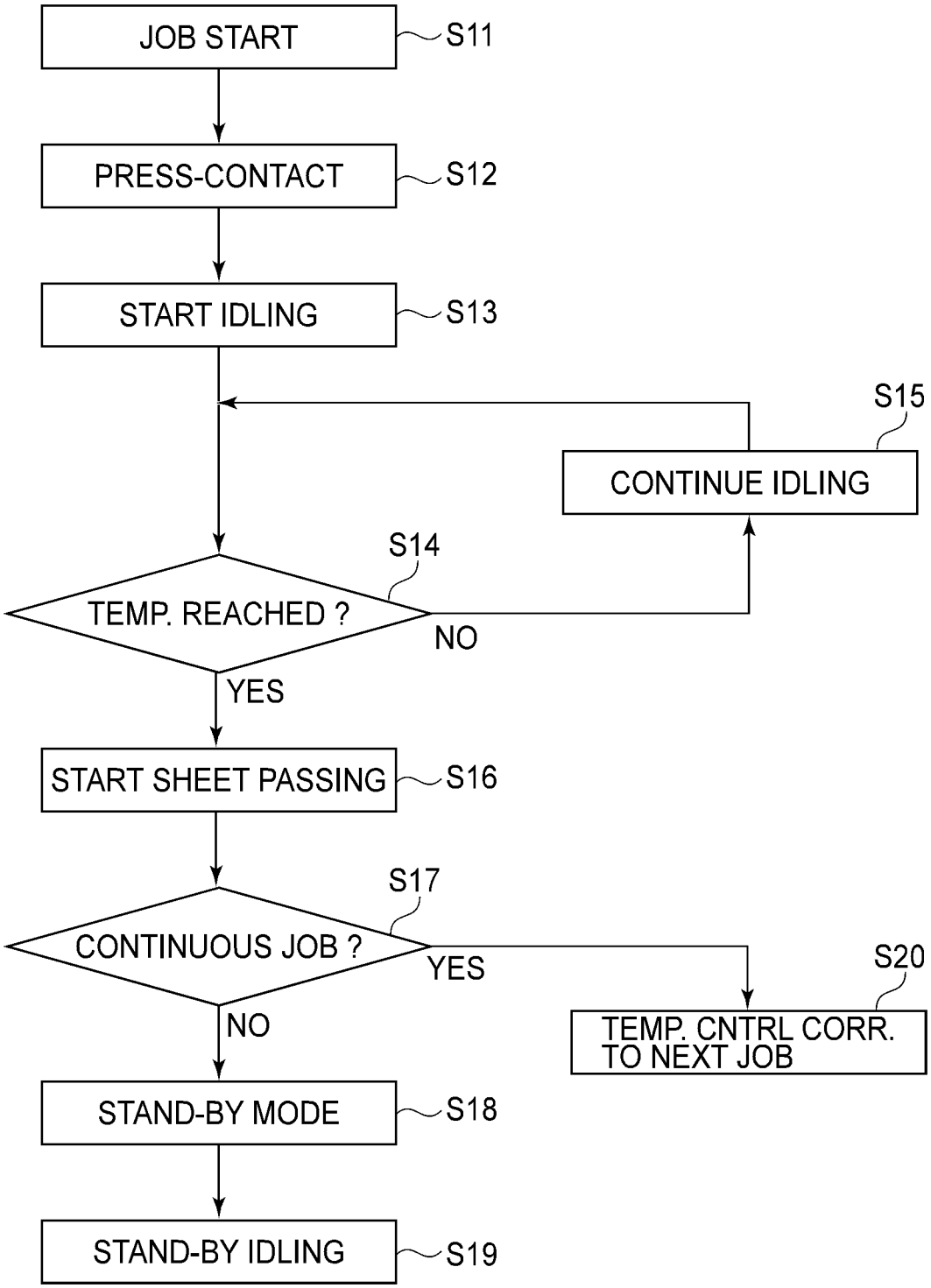

FIG. 11 is a flow chart of pressure control.

Figure 12:
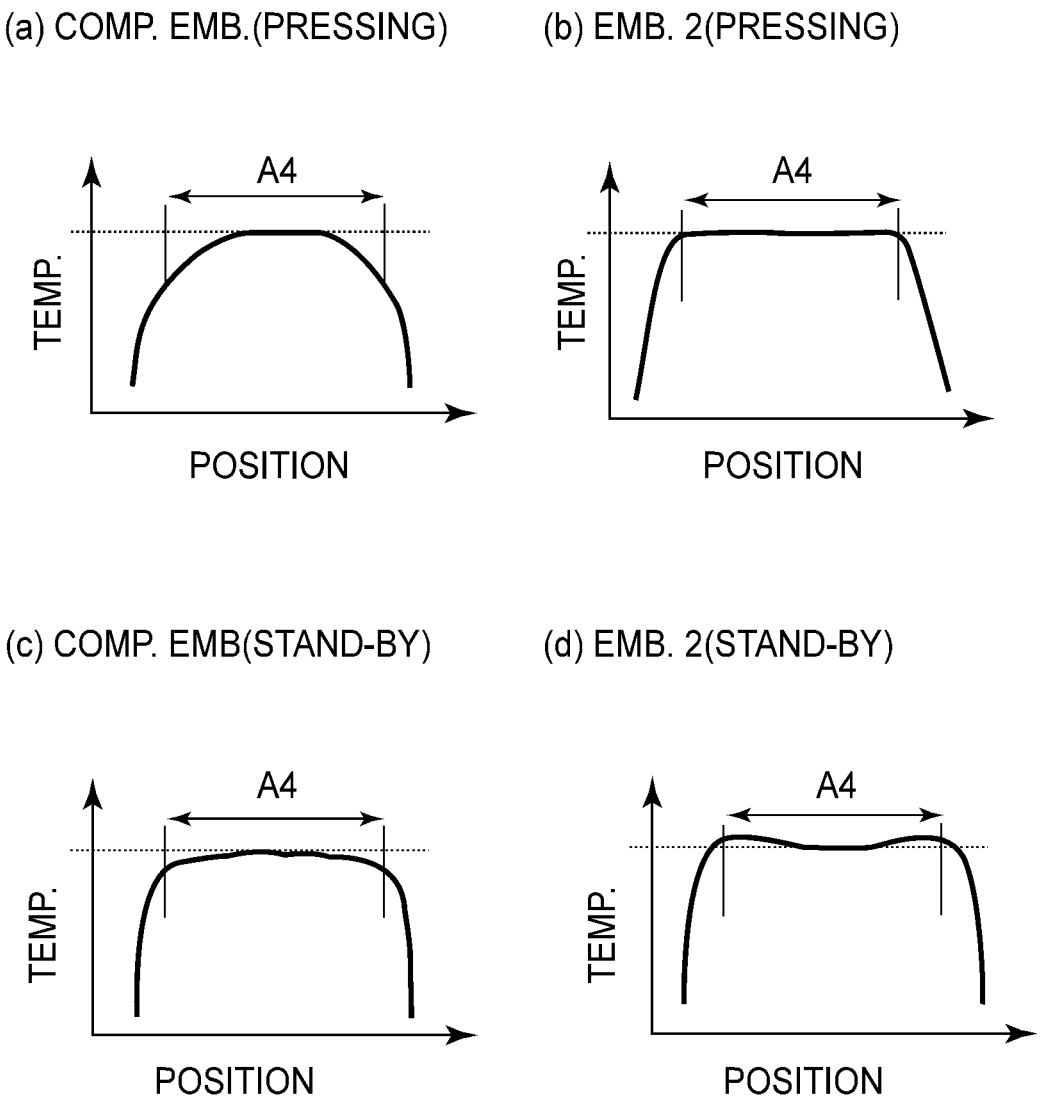

Parts (a) to (d) of FIG. 12 are illustrations of an effect of Embodiment 2.

Figure 13:
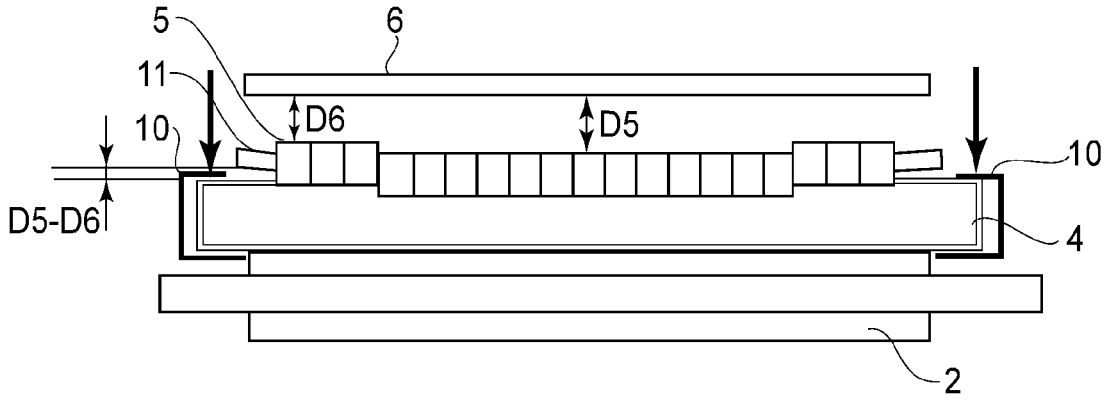

FIG. 13 is an illustration of the case where the spacer is not urged.

Figure 14:
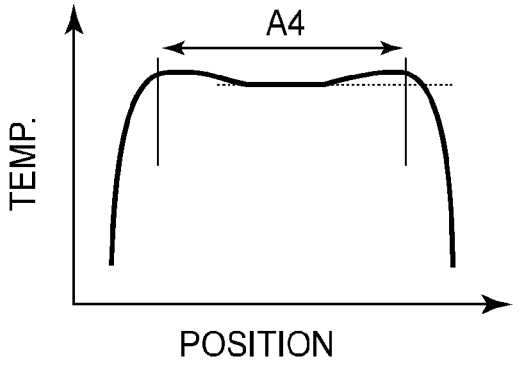

FIG. 14 is a graph showing a temperature distribution in the case where the spacer is not urged.

Figure 15:
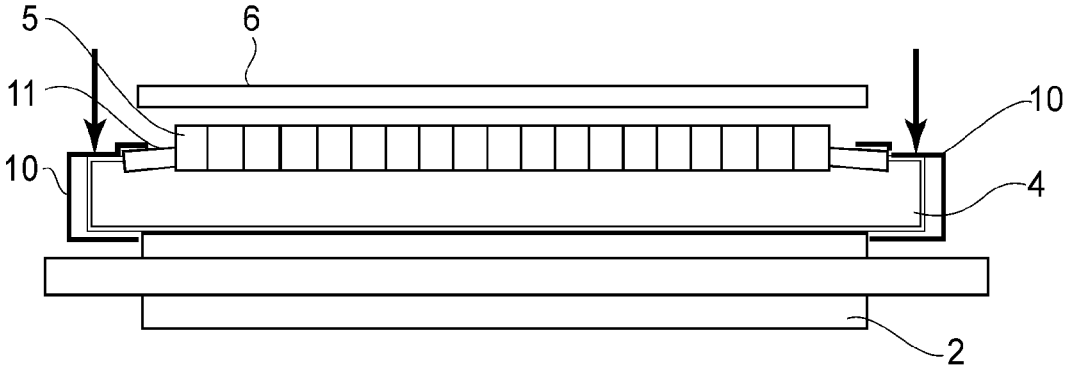

FIG. 15 is an illustration of a structure of a fixing film unit and a pressing roller in Embodiment 3.

DESCRIPTION OF THE PREFERRED EMBODIMENTS

Hereinbelow, embodiments of the present invention will be described in detail with reference to the drawings.

Incidentally, an image heating apparatus includes not only a fixing device for fixing a toner image on a recording material by heating the recording material on which the toner image is transferred, but also an image heating apparatus for providing a desired surface property to an image by heating a toner image.

An image forming apparatus in which the image heating apparatus is mounted can be carried out in the present invention irrespective of the types of monochromatic/full-color, sheet-feeding/recording material conveyance/intermediary transfer, the toner image forming method and the transfer method if employed in an image forming apparatus in which a toner image is fixed on a recording material onto which the toner image is transferred by heat and pressure.

In the following embodiments, while only a principal portion concerning formation/transfer/fixing of the toner image will be described, the present invention can be carried out in image forming apparatuses with various uses, including printers, various printing machines, copying machines, facsimile machines, multi-function machines, and so on by adding necessary equipment, options, or casing structures.

<Image Forming Apparatus>

Figure 1:
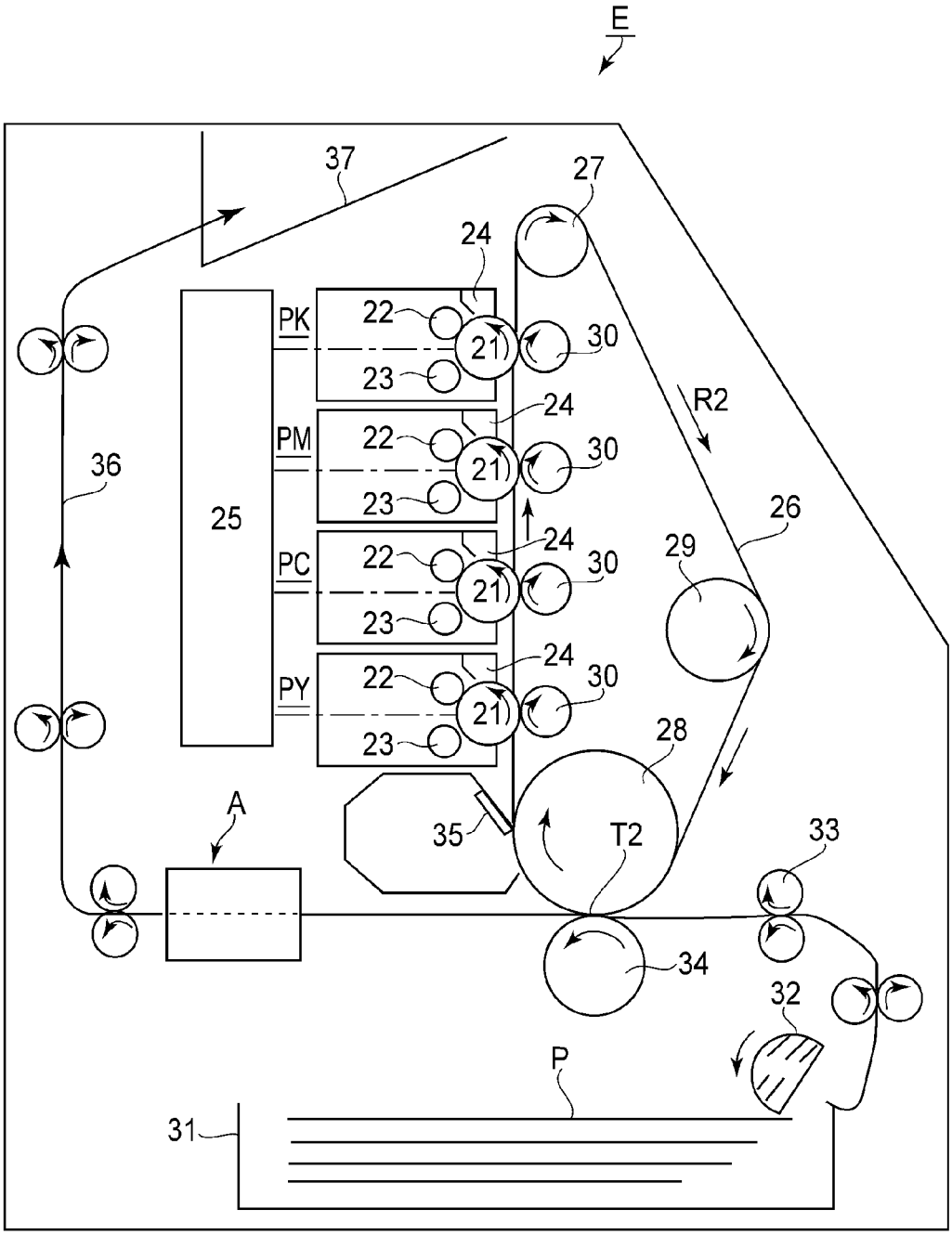
FIG. 1 is an illustration of a structure of an image forming apparatus.

FIG. 1 is an illustration of structure of an image forming apparatus.

As shown in FIG. 1, an image forming apparatus E in this embodiment is a tandem-type full-color printer of an intermediary transfer type in which image forming portions PY, PC, PM and PK for yellow, cyan, magenta and black, respectively, are arranged along an intermediary transfer belt 26.

In the image forming portion PY, a yellow toner image is formed on a photosensitive drum 21(Y) and then is primary-transferred onto the intermediary transfer belt 26. In the image forming portion PC, a cyan toner image is formed on a photosensitive drum 21(C) and is transferred superposedly onto the yellow toner image on the intermediary transfer belt 26. In the image forming portions PM and PK, a magenta toner image and a black toner image are formed on photosensitive drums 21(M) and 21(K), respectively, and are transferred onto the intermediary transfer belt 26.

The intermediary transfer belt 26 is constituted by an endless resin belt and is stretched around a driving roller 27, a secondary transfer opposite roller 28 and a tension roller 26, and is driven by the driving roller 27.

A recording material P is pulled out from a recording material cassette 31 one by one by a sheet feeding roller 32 and waits between registration rollers 33.

The recording material P is sent by the registration rollers 33 to a secondary transfer portion T2, where the toner images are secondary-transferred from the intermediary transfer belt 26 onto the recording material P. The recording material P on which the four color toner images are transferred is conveyed into a fixing device A, and after being heated and pressed by the fixing device A to fix the toner images at its surface, is discharged onto an external tray 36 through a discharging conveyance path 36.

The image forming portions PY, PC, PM and PK have substantially the same constitution, except that the colors of toners of yellow, cyan, magenta and black used in developing devices 23(Y), 23(C), 23(M) and 23(K) are different from each other. In the following description, the image forming portion PY will be described and the image forming portions PC, PM and PK will be omitted from redundant description.

The image forming station PY includes the photosensitive drum 21 around which a charging roller 22, an exposure device 25, the developing device 23, a primary transfer roller 30, and a drum cleaning device 24 are disposed.

The charging roller 22 electrically charges the surface of the photosensitive drum 21 to a uniform potential. The exposure device 25 writes (forms) an electrostatic image for an image on the photosensitive drum 21 by scanning with a laser beam. The developing device 23 develops the electrostatic image to form the toner image on the photosensitive drum 21. The primary transfer roller 30 is supplied with a PC voltage, so that the toner image on the photosensitive drum 21 is primary-transferred onto the intermediary transfer belt 26.

In recent years, as an image heating member for the fixing device, a fixing belt using an endless belt having a small thermal capacity and a high degree of latitude in arrangement has been proposed in order to further shorten a rise time. For this reason, the fixing device A uses the fixing belt as a fixing member.

<Fixing Device>

Figure 2:
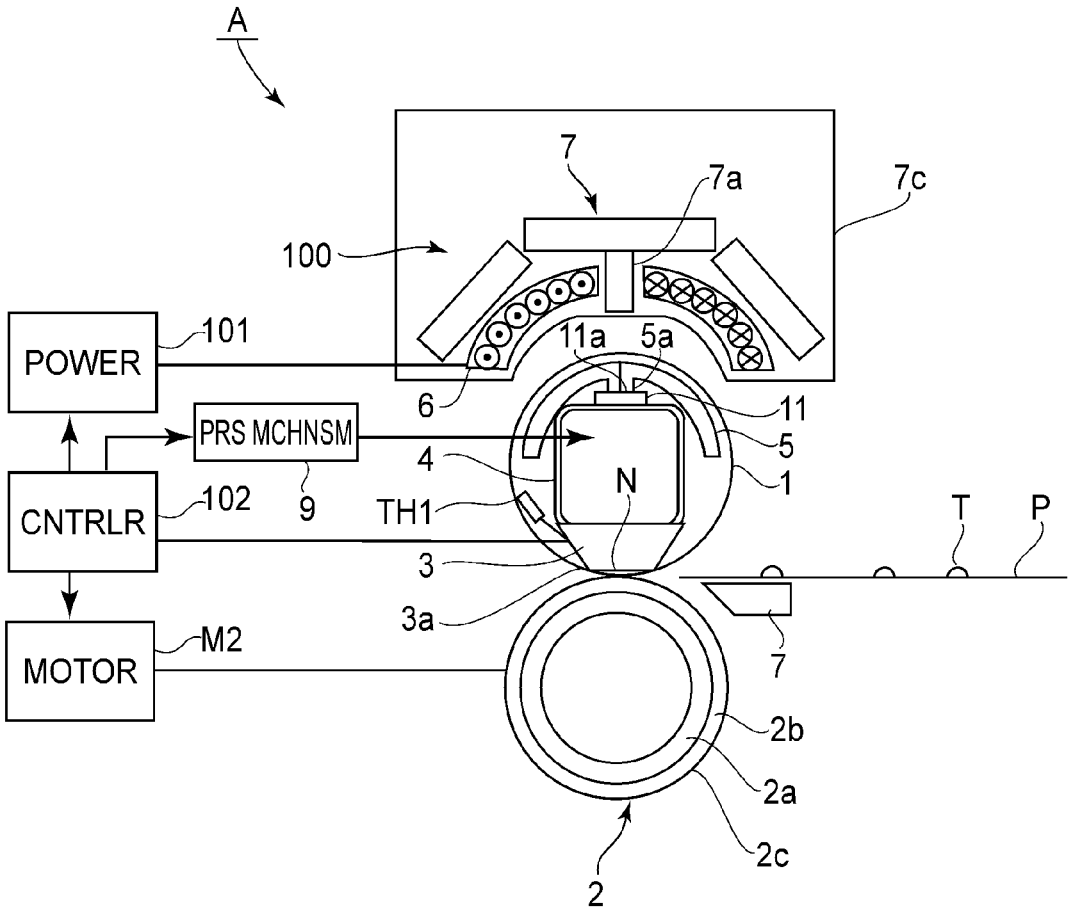
FIG. 2 is an illustration of a structure of a principal portion of a fixing device (image heating apparatus).

FIG. 2 is an illustration of a structure of a principal portion of the fixing device as the image heating apparatus. In the following description, a longitudinal direction of the members refers to a widthwise direction of the belt member, i.e., a direction perpendicular to a recording material conveyance direction. Further, a short direction of the members refers to the recording material conveyance direction. With respect to the fixing device, a front surface refers to a surface as seen from a recording material entrance side, and a rear surface refers to a surface as seen from a recording material exit side. The left (side) and the right (side) of the fixing device refer to left (side) and right (side) as seen from the photosensitive member side. An upstream side and a downstream side refer to an upstream side and a downstream side with respect to the recording material conveyance direction.

As shown in FIG. 2, a fixing belt 1, which is an example of the belt member, is rotatably provided so that its outer peripheral surface opposes an exciting coil 6, which is an example of a coil member for generating magnetic flux, and generates heat by the magnetic flux. A pressing roller 2, which is an example of a rotatable pressing member, contacts the outer peripheral surface of the fixing belt 1 to form a heating nip for the recording material. A stay 4 and a slider 3, which are an example of a supporting member, support the inner surface of the fixing belt 1 along the rotational axis direction of the fixing belt 1.

The slider 3 is a contact member which slides on the inner surface of the fixing belt 1. The stay 4 is provided so as to extend along a rotational axis direction of the fixing belt 1 and supports the slider 3. A spacer 11 is fixed on the stay 4 at a side opposite from the slider 3 and integrally supports a plurality of inner magnetic cores 5 which are each an example of a core. The spacer 11 is formed so that its thickness is gradually decreased from a central side toward an outer side with respect to the rotational axis direction of the fixing belt 1.

An outer (outside) magnetic core 7, which is an example of an outer core, is formed of a magnetic material and is provided opposed to the outer peripheral surface of the fixing belt 1 along the rotational axis direction of the fixing belt 1 at a side opposite from the pressing roller 2. The spacing (gap) between an end portion-side inner magnetic core 5 and the exciting coil 6 is the distance between the end portion-side inner magnetic core 5 and the outer magnetic core 7. The spacing between a central portion-side inner magnetic core 5 and the exciting coil 6 is the distance between the central portion-side inner magnetic core 5 and the outer magnetic core 7.

The fixing belt 1 has a metal layer to be subjected to induction heating and is 30 mm in inner diameter and is the endless belt member. The fixing belt 1 is rotated while being supported by the slider 3 at its inner surface. The slider 3 is fixed and non-rotatably disposed on the stay 4, which extends along the rotational axis direction of the fixing belt 1, thus sliding on the inner surface of the fixing belt 1 at an opposing position to the pressing roller 2.

The pressing roller 2 is 30 mm in outer diameter and is contacted to the outer surface of the fixing belt 1 to form a heating nip N between itself and the fixing belt 1. A control circuit portion 102 controls a motor M2 to rotationally drive the pressing roller 2. The fixing belt 1 is rotated by rotation of the pressing roller 2, and during image formation, is rotated at substantially the same peripheral speed as a conveyance speed of the recording material P conveyed from the secondary transfer portion (T2 in FIG. 1). The fixing device A melt-fixes unfixed toner images on the conveyed recording material by melting the toner images with heat. The fixing device A includes the fixing belt 1 having a surface rotational speed of 300 mm/sec, and is capable of continuously fixing a full-color image on the recording material at 80 sheets/min for A4-size landscape feeding and at 58 sheets/min for A4-size portrait feeding.

<Fixing Belt>

Figure 3:
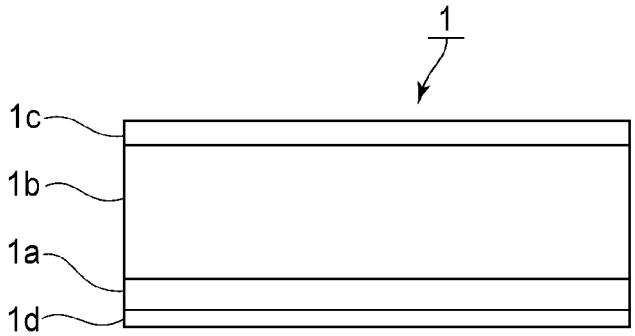
FIG. 3 is a schematic view showing a layer structure of a fixing belt.

FIG. 3 is a schematic view showing a layer structure of the fixing belt 1. As shown in FIG. 3, the fixing belt 1 includes a base layer (metal layer) 1*a* of nickel, which is 40 μm in thickness and is manufactured through electroforming. As the material for the base layer 1*a*, in addition to nickel, it is possible to appropriately select iron alloy, copper, silver or the like. A constitution in which a layer of a metal material is laminated on a resin base layer may also be employed. The thickness of the base layer 1*a* is adjusted depending on the frequency of a high-frequency current carried through the exciting coil described later and permeability and electrical conductivity of the metal layer and may preferably be set in a range of about 5-200 μm. At the inner surface of the base layer 1*a*, in order to lower sliding friction between the fixing belt 1 and a temperature sensor TH1, it is desirable that a lubricating layer (resin layer) 1*d* of fluorine-containing resin, polyimide or the like is provided in a thickness of 10-50 μm. In the fixing device A, as the lubricating layer 1*d*, the layer of polyimide is provided in the thickness of 20 μm.

At an outer peripheral surface of the base layer 1*a*, an elastic layer 1*b* of a heat-resistant silicone rubber is provided. The thickness of the elastic layer 1*b* may preferably be set within a range from 100 μm to 1000 μm. At an outer peripheral surface of the elastic layer 1*b*, a surface parting layer 1*c* of a fluorine-containing resin material layer (e.g., of PFA or PTFE) is provided in a thickness of 30 μm. In the fixing device A, the thickness of the elastic layer 1*b* is set at 300 μm in consideration of the design of the fixing belt to decrease the thermal capacity thereof to shorten a warming-up time and to obtain a suitable fixation image during the fixation of the color images. The material for the elastic layer 1*b* has a JIS-A hardness of 20 degrees and a thermal conductivity of 0.8 W/mK.

<Pressing Roller>

The pressing roller 2 includes an iron-made metal core 2*a* and an elastic layer 2*b* of a silicone rubber material provided at the outer surface of the metal core 2*a*. At the surface of the elastic layer 2*b*, a 30 μm-thick surface parting layer 2*c* of a fluorine-containing resin material layer (e.g., PFA or PTFE) is provided. The pressing roller 2 has an ASKER-C hardness (JIS) of 70 degrees at the central portion with respect to its longitudinal direction.

The metal core 2*a* of the pressing roller 2 is provided with a tapered shape (crown shape) so that the diameter at a longitudinal central portion is 20 mm and the diameter at each of longitudinal end portions is 19 mm. This is because pressure distribution in the heating nip N between the fixing belt 1 and the pressing roller 2 is uniformly ensured even in the case where the stay 4*d* and the slider 3 are integrally bent upward when the pressing roller 2 is pressed toward the stay 4 at its end portions.

The metal core 2*a* is provided with the tapered shape and therefore the width of the heating nip N of the fixing device A with respect to the rotational direction of the pressing roller 2 is about 9 mm at the both end portions of the pressing roller 2 and about 8.5 mm at the central portion of the pressing roller 2 with respect to the longitudinal direction of the pressing roller 2 under application of a total pressure of 500 N to the pressing roller 2. This constitution has the advantage such that the conveyance speed of the conveyed recording material P at the both end portions is higher than that at the central portion with respect to the widthwise direction of the recording material P, to thereby decrease the likelihood of the occurrence of a crease in the paper.

<Pressing Mechanism>

Part (a) of FIG. 4 is an illustration of a structure of the fixing device with respect to the distance, and (b) of FIG. 4 is a perspective view of the inner magnetic core. As shown in (a) of FIG. 4, a fixing flange 10 is each of left and right regulating (preventing) members for preventing movement of the fixing belt 1 in the longitudinal direction and for regulating a shape of the fixing belt 1 with respect to a circumferential direction. The rotating fixing belt 1 includes the case layer constituted by the metal material and therefore as a means for preventing lateral shift of thereof in the rotational axis direction even in a rotating state, provision of the fixing flange 10 to the extent that the fixing flange 10 can simply receive the end portion of the fixing belt 1 is sufficient. As a result, there is the advantage that the structure of the fixing device A is simplified.

The stay 4 and the slider 3 are fixed between the fixing flanges 10 at their end portions and are non-rotatably disposed while extending along the longitudinal direction of the fixing belt 1. The slider 3*d* is formed of a heat-resistant resin material and supports the inner surface of the fixing belt 1 in a state in which it is supported over its full length by the stay 4.

The stay 4 is required to have rigidity in order to apply the pressure to the heating nip N via the slider 3. For that reason, the stay 4 is made of iron. Between each of the both ends of the stay 4 inserted into and provided inside the fixing flange 10 and a cam-receiving member 9 provided at a casing side of the fixing device A, a stay urging spring 9*b* is compressedly provided. A cam 9*c* applies a pushing down force to the stay 4 via the stay urging spring 9*b* to sandwich the fixing belt 1 between the lower surface of the slider 3 and the upper surface of the pressing roller 2, so that the heating nip N is formed between the pressing roller 2 and the fixing belt 1. At this time, the lower surface of the fixing flange 10 and the upper surface of the pressing roller 2 nip and press-contact the fixing belt 1 at their both end portions. As a result, at the central portion, permanent deformation of the elastic layer of the pressing roller 2 and the fixing belt 1 is prevented.

<Induction Heating Device>

As shown in FIG. 2, the fixing device A employs an electromagnetic induction heating-type method, in which an electroconductive layer is provided in the fixing belt 1 as a means for heating the fixing belt 1 and is caused to generate heat by electromagnetic induction heating. The fixing device 1 includes the exciting coil 6 disposed opposed to the electroconductive layer, so that the magnetic flux which penetrates through the electroconductive layer is generated. The exciting coil 6 is disposed opposed to the outer surface of the fixing belt 1 so as to oppose the electroconductive layer. An AC magnetic field penetrates through the electroconductive layer of the fixing belt 1 to generate eddy current, so that the electroconductive layer is heated by Joule heat. Compared with the roller-heating type, the fixing belt 1 having a small weight is directly heated and therefore the fixing belt 1 can be heated to a predetermined temperature is a very short time. For this reason, compared with the case where a heat generating member such as a halogen lamp or the like is used as a heat generating source, warming-up of the fixing device A can be efficiently performed.

An induction heating device 100 causes the AC magnetic field to act the fixing belt 1 via the outer magnetic core 7*a* to induction-heat the fixing belt 1. The induction heating device 100 is provided opposed to the fixing belt 1 with a predetermined gap (spacing) at an upper portion of the outer peripheral surface of the fixing belt 1. The fixing belt 1 and the exciting coil 6 of the induction heating device 100 keep their electrically insulating state by a 0.5 mm-thick mold layer, and the gap between the fixing belt 1 and the exciting coil 6 is constant at 1.5 mm (the distance between the mold surface and the fixing belt surface is 1.0 mm).

The mold member 7*c* integrally supports the outer magnetic core 7*a* and the exciting coil 6 by an electrically insulating resin material. However, the outer magnetic core 7*a* at each of the end portions with respect to the rotational axis direction is supported so that its opposing distance from the fixing belt 1 is changeable, and is retracted into a non-sheet-passing region in order to avoid overheating in the non-sheet-passing region at each of the end portions of the fixing belt 1. As a result, the fixing belt 1 is uniformly heated in a region extending to the both end portions which are not subjected to cooling by the recording material.

The exciting coil 6 is supplied with the AC current to cause the AC magnetic field to act the outer magnetic core 7*a*, so that the magnetic flux is generated with a high efficiency. The exciting coil 6 uses Litz wire as an electric wire, and the Litz wire is elongated and wound in a ships bottom-like shape so as to oppose a part of the peripheral surface and side surface of the fixing belt 1. The outer magnetic core 7*a* is disposed to cover the exciting coil 6 so that the magnetic field generated by the exciting coil 6 is substantially leaked out of the base layer 1*a* of the fixing belt 1.

In a rotation state of the fixing belt 1, to the exciting coil 6 of the induction heating device 100, a high-frequency current of 20-50 kHz is applied from a power source device (exciting circuit) 101. By the magnetic field generated by the exciting coil 6, the base layer 1*a* of the fixing belt 1 is induction-heated.

A temperature sensor TH1 is a temperature detecting element, such as a thermistor, for detecting the temperature of the fixing belt 1 at a substantially center of a sheet passing width of the recording material P. The temperature sensor TH1 extends from the slider 3 and is attached via an elastic supporting member and even when positional fluctuation of the fixing belt 1 such as waving of the contact surface occurs, the temperature sensor TH1 follows the positional fluctuation to maintain a good contact state. Detected temperature information of the temperature sensor TH1 is fed back to electric power which is inputted from the power source device 101 into the exciting coil 6.

A control circuit portion 102 controls the electric power inputted from the electric power device 101 into the exciting coil 6 so that a detection temperature of the temperature sensor TH1 is kept at a predetermined target temperature (fixing temperature). The control circuit portion 102 controls the electric power inputted into the exciting coil 6 by changing the frequency of the high-frequency current on the basis of a detection value of the temperature sensor TH1. In the case where the detection temperature of the fixing belt 1 is increased to 200° C. which is the upper limit temperature, energization to the exciting coil 6 is interrupted.

Referring to FIG. 2, when an image forming job is received, the control circuit portion 102 starts electric power supply from the power source device 101 to the exciting coil 6 of the induction heating device 100. When the fixing belt 1 is increased in temperature up to the predetermined fixing temperature to be placed in a temperature-controlled state, the control circuit portion 102 starts image formation. As a result, the recording material P carrying the unfixed toner image T thereon is guided by a guide member 7 with a toner image-carrying surface directed toward the fixing belt 1, thus being introduced into the heating nip N. In the state in which the fixing belt 1 is increased in temperature up to the predetermined fixing temperature and is temperature-controlled, between the fixing belt 1 and the pressing roller 2, the recording material P carrying the unfixed toner image T thereon is introduced.

The recording material P causes the unfixed toner T to hermetically contact the outer peripheral surface of the fixing belt 1 and then is nip-conveyed through the heating nip N together with the fixing belt 1 while overlapping with the fixing belt 1. The unfixed toner image T receives the pressure in the heating nip N while being supplied with the heat of the fixing belt 1, thus being fixed on the surface of the recording material P. The recording material P which passes through the heating nip N is, due to deformation of the elastic layer of the fixing belt 1 by large curvature at an exit portion of the heating nip N, self-separated from the outer peripheral surface of the fixing belt 1 and then is conveyed to the outside of the fixing device A.

In the fixing device A, the induction heating device 100 including the exciting coil 6 is not disposed inside the fixing belt 1, whose temperature becomes high, but is disposed outside the fixing belt 1. For this reason, the temperature of the exciting coil 6 does not readily become high and its electric resistance is also not increased, so that it becomes possible to alleviate loss due to the Joule heating, even when the high-frequency current is carried. Further, the exciting coil 6 is externally disposed, so that it also contributes to a reduction in diameter (realization of low thermal capacity) of the fixing belt 1, and thus the fixing device A also has an excellent energy saving property.

The fixing device A has a constitution in which a heated portion has a very small thermal capacity and therefore when, e.g., 1200 W is inputted into the exciting coil 6, the temperature of the fixing belt 1 can reach 160° C., which is the target temperature, in about 15 sec, so that the warming-up time during actuation is short. For this reason, a heating operation during stand-by becomes unnecessary and therefore the amount of electric power consumption can be suppressed to a very low level.

<Inner Magnetic Core>

Inside the fixing belt 1, a plurality of inner magnetic cores 5 are provided and arranged in the rotational axis direction of the fixing belt 1. The inner magnetic cores 5 can also be directly applied onto the stay 4 without via the spacer 11, but from the viewpoint of the fixing property, the inner magnetic cores 5 are applied to the stay 4 via the spacer 11. Here, the stay 4 has the function as a supporting member for supporting the inner magnetic cores 5. As the material for the spacer 11, the heat-resistant resin material such as PPS resin may preferably be used. As the material for the inner magnetic cores 5, a material, such as ferrite or permalloy, which has high permeability and low residual magnetic flux density is suitable.

The inner magnetic cores 5 function as a magnetic shielding member for preventing a temperature rise of the stay 4 and the like due to the induction heating. The stay 4 is close to the exciting coil 6 at its end portions, and in order to prevent the heat generation of the stay 4 by shielding the magnetic field generated by the exciting coil 6, the plurality of inner magnetic cores 5 are disposed on the upper surface of the stay 4 over the longitudinal direction of the stay 4. In this embodiment, the inner magnetic cores 5 having the same shape are disposed over the longitudinal direction.

Further, the inner magnetic cores 5 function as a magnetic circuit member for guiding the magnetic flux, which is emitted from the outer magnetic core 7*a* and penetrates through the fixing belt 1, in the circumferential direction. The magnetic circuit is formed inside the fixing belt 1, so that the magnetic field generated by the exciting coil 6 efficiently passes through the fixing belt 1, and therefore the heat generation efficiency of the induction heating by the exciting coil 6 is improved.

As shown in (b) of FIG. 4, each of the inner magnetic cores 5 are molded in ¼ arcuate shape by using sintered ferrite and is provided with a projection 5*a* at one end thereof. The adjacent two inner magnetic cores 5 with respect to the circumferential direction are bonded to each other to obtain, as a whole, a semicircular-shaped magnetic core of 2 mm in thickness t, 16.2 mm in height h, 28 mm in width w and 12 mm in length l is obtained.

Incidentally, in the fixing device A of the induction-heating type, at an opening end of each of longitudinal end portions of the cylindrical fixing belt 1, compared with the central portion, the amount of heat dissipation is large, and thus temperature lowering is liable to occur. The thermal capacity at the portion to be heated is small, and therefore the influence of heat taken by the pressing roller 2 having a low temperature relative to the fixing belt 1 becomes large. For this reason, in the heating nip N where the fixing belt 1 contacts the pressing roller 2, a uniform temperature distribution with respect to the rotational axis direction cannot be obtained, so that the temperature is liable to be lowered at the opening end portions. When sufficient heat energy cannot be supplied to the toner image T on the recording material P at the opening end portions, the fixing belt 1 is separated from the recording material P before the toner is melted on the recording material P, so that there is an increasing possibility that the toner is deposited on the fixing belt 1 and is carried away (offset).

For that reason, in JP-A 2004-31154, the magnetic resistance of the plurality of inner magnetic cores arranged in the rotational axis direction is gradually lowered from the central portion toward the outer portions. The heating efficiency is enhanced by increasing the magnetic flux penetrating through the fixing belt at the end portions, so that the temperature lowering at the end portions is made up for. The fixing belt and the plurality of inner magnetic cores are equidistantly provided and on the other hand, the inner magnetic cores are molded so that the cross-sectional area thereof at the end portions is larger than that at the central portion. As a result, the temperature distribution with respect to the longitudinal direction is uniformized by increasing the amount of heat generation at the longitudinal end portions without requiring a high degree of mechanical accuracy.

In the fixing device A using the fixing belt 1, a constitution is provided in which the exciting coil 6 is disposed at the outer peripheral surface of the fixing belt 1 and the inner magnetic cores 5 are disposed on the stay 4 on which the pressure acts in order to improve the heat generation efficiency. Here, in order to cause the fixing belt 1 and the pressing roller 2 to press-contact each other, when the pressing roller 2 is intended to be caused to press-contact the fixing belt 1 by using the end portions of the stay 4, the stay 4 is bent.

For that reason, with respect to the plurality of inner magnetic cores 5 arranged in the rotational axis direction, even when the opposing distance to the exciting coil 6 is the same in a non-pressure application state, the opposing distance to the exciting coil 6 varies depending on the degree of the bending of the stay 4 in a pressure application state. There arises a problem that the opposing distance between the exciting coil 6 and the inner magnetic cores 5 at the end portions is increased compared with that at the central portion and the amount of heat generation is lowered at the end portions and thus a uniform temperature distribution with respect to the rotational axis direction cannot be obtained.

In the following embodiments, a reverse crown shape corresponding to an amount of the bending of the stay 4 is provided to the spacer 11 and the inner magnetic cores 5 are disposed on the stay 4, so that a proper longitudinal temperature distribution can be obtained with a simple constitution at the time of the press contact between the exciting coil 6 and the pressing roller 2.

Embodiment 1

Parts (a) and (b) of FIG. 5 are illustrations of a crown-shaped stay. FIG. 6 is an illustration of the distance between an exciting coil and the inner magnetic core. Parts (a) to (c) of FIG. 7 are illustrations of a structure of a spacer in Embodiment 1. Parts (a) and (b) of FIG. 8 are illustrations of a change in distance between the inner magnetic core and another magnetic core under no pressure application and under pressure application, respectively. Parts (a) and (b) of FIG. 9 are illustrations of an effect of Embodiment 1.

As shown in (a) of FIG. 4, the end portion-side inner magnetic cores 5, which are an example of a first core, are formed of the magnetic material and are disposed inside the fixing belt 1. The central portion-side inner magnetic cores 5, which are an example of a second core, are formed of the magnetic material and are disposed at the central portion side relative to the end portion-side inner magnetic cores 5 with respect to the rotational axis direction.

The stay urging springs 9*b*, which are an example of the urging means, urge the stay 4 and the pressing roller 2 at the end portions with respect to the rotational axis direction of the fixing belt 1. When the pressure application of the stay urging springs 9*b* is released (removed), the gap between the end portion-side inner magnetic cores 5 and the exciting coil 6 becomes smaller than the gap between the central portion-side inner magnetic cores 5 and the exciting coil 6. In that way, the end portion-side inner magnetic cores 5 and the central portion-side inner magnetic cores 5 are disposed above the stay 4. When the pressure application of the stay urging springs 9*b* on the stay 4 is in effect during the image heating, the gap between the end portion-side inner magnetic cores 5 and the exciting coil 6 and the gap between the central portion-side inner magnetic cores 5 and the exciting coil 6 became smaller than those when the pressure application by the stay urging springs is released.

As shown in (a) of FIG. 4, by the bending of the stay 4 urged at the end portions, a contact pressure between the fixing belt 1 and the pressing roller 2 is very large at the longitudinal end portions, so that there is a possibility of an occurrence of a decrease in pressure at the longitudinal central portion. In order to solve this problem, it would be considered to project or cause bulging at the central portion of at least one of the slider 3 and the stay 4 with respect to the rotational axis direction of the fixing belt 1.

As shown in (b) of FIG. 5, the stay 4 in Embodiment 1 is provided with a hyperbola-like crown shape such that the central portion is projected with a crown amount of A. In Embodiment 1, in order to obtain a uniform pressure distribution along the rotational axis direction in the heating nip N with respect to the pressure of 500 N as the total pressure, the crown amount of the stay 4 is set at 1.3 mm.

As shown in (b) of FIG. 5, during the pressure application, the lower surface of the stay is linearly bent, so that the uniform pressure distribution can be obtained with respect to the rotational axis directions of the fixing belt 1 and the pressing roller 2. However, as a result, the upper surface of the stay 4 is convexly deformed upward, so that the inner magnetic cores 5 (FIG. 4) disposed at the central portion of the stay 4 increase the opposing distance to the outer magnetic core 7 more than the inner magnetic cores 5 (FIG. 4) disposed at the outer portions with respect to the rotational axis direction. In the case where the inner magnetic cores 5 are simply applied along a non-pressure surface, when the pressing roller 2 is press-contacted to the fixing belt 1, the distance between the exciting coil 6 and the inner magnetic cores 5 at the end portions with respect to the rotational axis direction is remarkably increased compared with that at the central portion.

As shown in FIG. 6, the distance between the exciting coil 6 and the inner magnetic cores 5 refers to a distance D between the opposing surface of the exciting coil 6 to the fixing belt 1 and the opposing surface of the inner magnetic cores 5 to the fixing belt 1. When the distance D at the outer portions becomes larger than that at the central portion with respect to the rotational axis direction, the magnetic flux generated by the exciting coil 6 locally penetrates through the fixing belt 1 toward the central portion-side inner magnetic cores 5 with the small opposing distance. As a result, at the central portion of the fixing belt 1 with respect to the rotational axis direction, an overheating state is created, and at the outer portions (end portions), heating becomes insufficient. In order to uniformize the amount of heat generation of the fixing belt 1 between the central portion and the outer portions, there is a need to equidistantly dispose the exciting coil 6 and the inner magnetic cores 5 between the central portion and the outer portions.

As shown in (a) of FIG. 7, in Embodiment 1, at the end portions of the spacer 11 as an adjusting means, the mounting height of the inner magnetic cores 5 (the height of a supporting surface for the inner magnetic cores 5) is set in advance at a value higher than that at the central portion so that the mounting height of the inner magnetic cores 5 becomes uniform between the end portions and the central portion in the bending state of the stay 4 under pressure application. As shown in FIG. 5, during the press-contact between the fixing belt 1 and the pressing roller 2, the stay 4 is bent by the distance A, the end portion-side inner magnetic cores 5 are spaced from the exciting coil 6 more than the central portion-side inner magnetic cores 5 by the distance A equal to the crown amount. Therefore, in order to uniformize the amount of heat generation of the fixing belt 1 with respect to the rotational axis direction, there is a need to provide an amount of a reverse crown, capable of cancelling the crown amount A of the stay 4, to the spacer 11.

As shown in (b) of FIG. 7, the spacer 11 is provided with a reverse crown shape correspondingly to the bending amount of the stay 4. The reverse crown shape with a reverse crown amount B is provided to the spacer 11 so that the reverse crown amount B cancels the bending amount of the stay 4 under pressure application. The shape of the spacer 11 with respect to the rotational axis direction is formed like a concave hyperbola shape, and at that time, the height at the central portion is 1 mm, and on the other hand, the height at the end portions is about 2.3 mm, which is higher than the height at the central portion by 1.3 mm. As the spacer 11, a spacer of 1 mm in height H at the longitudinal central portion, 400 mm in longitudinal width W and 10 mm in width L with respect to the conveyance direction is used.

Incidentally, the reverse crown shape may also be provided at a side where the stay 4 contacts the spacer 11 but the stay 4 is designed so that bending rigidity and strength as a structure member take precedence over other factors, and therefore it is preferable that the reverse crown shape is provided to the spacer 11 also in view of a processing problem.

Further, the reverse crown shape may also be a V-shape such that the height position of the inner magnetic cores 5 during no-pressure application is linearly raised from the central portion toward the outer portions. However, the crown shape provided to the stay is the hyperbola-like shape and therefore it is desirable that the same hyperbola-like shape is employed.

As shown in (c) of FIG. 7, at the upper surface of the spacer 11, an opening 11*a* in which the projection of the inner magnetic cores 5 is inserted and adhesively bonded is provided. As shown in (a) of FIG. 7, in the opening 11*a*, the projection 5*a* of the inner magnetic cores 5 is engaged. Along the rotational axis direction of the fixing belt 1, 30 inner magnetic cores 5 in total are equidistantly arranged and disposed. Each of the inner magnetic cores 5 is disposed with a distance (spacing) of 0.65 mm from an adjacent inner magnetic core.

As shown in (a) of FIG. 8, during non-pressure application, a distance D1 between the exciting coil 6 and the inner magnetic cores 5 at the end portions is 5 mm and a distance D2 between the exciting coil 6 and the inner magnetic core 5 at the central portion is 6.3 mm.

As shown in (b) of FIG. 8, during pressure application, a distance D3 between the exciting coil 6 and the inner magnetic cores 5 at the end portions is mm and a distance D4 between the exciting coil 6 and the inner magnetic core 5 at the central portion is 5 mm.

Here, the reason why the distance between the exciting coil 6 and the inner magnetic cores 5 at the end portions is not changed between during the non-pressure application and during the pressure application is that the exciting coil 6 is supported by the flanges 10 engaged with the stay 4 at the end portions of the stay 4. As a result, at the end portions of the stay 4, the positional relationship between the exciting coil 6 and the inner magnetic cores 5 is always kept constant.

As shown in (a) and (b) of FIG. 9, in a comparative embodiment ((a) in which the reverse crown shape is not provided and in Embodiment 1(b)) in which the reverse crown shape is provided, the temperature distribution in the heating nip N with respect to the rotational axis direction after a lapse of 30 sec from heating start of the fixing device A from a room-temperature state was measured and compared.

As shown in (a) of FIG. 9, in the comparative embodiment in which the spacer 11 is not provided with the reverse crown shape, the distance D becomes larger at the end portions than the central portion with respect to the rotational axis direction in the heating nip N under the pressure application, and therefore, the amount of heat generation at the end portions is lowered, so that the temperature lowering is conspicuous compared with that at the central portion. For this reason, fixing non-uniformity is caused between the end portions and the central portion, so that the image quality is lowered.

As shown in (b) of FIG. 9, in Embodiment 1 in which the spacer 11 is provided with the reverse crown shape, the distance D is the same between the end portions and the central portion with respect to the rotational axis direction in the heating nip N under the pressure application and therefore the amount of heat generation also becomes the same, so that a uniform temperature distribution can be obtained over the entire region. For this reason, image formation with a good quality can be effected. The spacer 11 is provided with the reverse crown shape correspondingly to the bending amount of the stay 4 and then the inner magnetic cores 5 are applied to the spacer 11, so that the uniform temperature distribution in the heating nip N can be obtained during the press-contact between the fixing belt 1 and the pressing roller 2.

According to Embodiment 1, by a simple constitution in which the shape of the spacer 11 is only changed, the temperature distribution in the heating nip N with respect to the rotational axis direction can be uniformized.

Incidentally, by making the reverse crown amount B of the spacer 11 larger than that in Embodiment 1, the amount of heat generation at the end portions is larger than that in Embodiment 1, so that the degree of the temperature lowering at the end portions during idling heating can also be alleviated.

Further, by making the reverse crown amount B of the spacer 11 smaller than that in Embodiment 1, the amount of heat generation at the end portions is smaller than that in Embodiment 1, so that an excessive temperature rise at the non-sheet-passing portions may also be suppressed.

Incidentally, in this embodiment, the constitution is employed in which the shape of the inner magnetic cores is the same, but the constitution in which the height of the supporting surface of the spacer is different, may also be applied to the case where the shape of the end portion-side inner magnetic core and the shape of the central portion-side inner magnetic cores are different from each other.

Further, different from this embodiment, a constitution in which the spacer is divided into a plurality of spacer portions and then is disposed may also be employed. Specifically, the constitution in such that a first spacer portion for the end portion cores and a second spacer portion, for the central portion cores, smaller in height than that of the first spacer portion are disposed. Also in such a constitution, an effect similar to the effect of the present invention can be obtained.

Embodiment 2

Parts (a) and (b) of FIG. 10 are illustrations during image formation (pressure application) and during stand-by, respectively. FIG. 11 is a flow chart of pressure control.

Parts (a) to (d) of FIG. 12 are illustrations of an effect of Embodiment 2.

In Embodiment 2, in the fixing device A in Embodiment 1, during stand-by, an operation of the fixing device A which puts a higher premium on the heating at the end portions than that during the image formation is performed.

During a stand-by operation, which awaits a signal for image formation, the fixing belt 1 is subjected to heating idling, and therefore in the case where the heating idling is performed for a long time, even when the amount of heat generation of the fixing device is the same with respect to the rotational axis direction, the amount of heat dissipation at the end portions through the pressing roller 2 or the like is large, so that temperature lowering occurs at the end portions.

In order to prevent this temperature lowering, in Embodiment 2, during the stand-by operation, the pressure between the fixing belt 1 and the pressing roller 2 is lowered. As shown in FIG. 4, the control circuit portion 102 controls the motor 9*d* to rotate a portion 9*c* thereof, whereby the pressure of the pressing roller 2 applied to the fixing belt 1 is changed. The control circuit portion 102, which is an example of a controller, controls the urging force of the stay urging spring 9*b*, so that in the stand-by state in which the fixing device awaits the image heating, compared with during the image heating, the gap between the end portion-side inner magnetic cores 5 and the exciting coil 6 is made smaller than the gap between the central portion-side inner magnetic cores 5 and the exciting coil 6.

As shown in (a) of FIG. 10, during actuation and during the image formation, the pressure of 500 N as a maximum total pressure acts on the stay 4, so that the stay 4 is largely bent upward. At this time, as described in Embodiment 1, the distance between the exciting coil 6 and the inner magnetic cores 5 is the same between the central portion (D4) and the end portions (D3), so that the fixing belt 1 is uniformly heated with respect to its rotational axis direction.

As shown in (b) of FIG. 10, during the stand-by operation which awaits the image formation, idling is performed, so that the pressure of the pressing roller 2 applied to the fixing belt 1 is set at a low value. For this reason, the amount of the bending of the stay 4 becomes smaller than that during image formation, so that the central portion-side inner magnetic cores 5 is spaced farther from the exciting coil 6 than the end portion-side inner magnetic cores 5 by a distance C, and thus the amount of heat generation becomes relatively high at the end portions.

In Embodiment 2, the pressure between the fixing belt 1 and the pressing roller 2 during the stand-by operation is set at 350N at the total pressure and therefore the distance D1 between the exciting coil 6 and the inner magnetic cores 5 at the end portions is 5 mm and the distance D2 between the exciting coil 6 and the inner magnetic cores at the central portion is 5.4 mm. For this reason, the central portion-side inner magnetic cores 5 is spaced farther from the exciting coil 6 than the end portion-side inner magnetic cores 5 by 0.4 mm.

As a result, even when there is a tendency for the heat to dissipate at the end portions to cause the temperature lowering, the amount of heat generation is large, and therefore the temperature distribution is uniformized from the central portion to the end portions.

As shown in FIG. 11 with reference to FIG. 4, when an image forming job is received (S11), the fixing belt 1 and the pressing roller 2 are press-contacted to each other (S12) and then the heating idling is started (S13). When the temperature reaches the target temperature (YES Of S14), the image formation is started (S16). In the case where there is no subsequent image forming job (NO of S17), the sequence goes to an operation in a stand-by mode in which the stand-by operation is performed (S18).

In the stand-by mode, stand-by idling in which the pressure is weakened compared with that during the image formation is performed (S19). As a result, also during the stand-by idling (S19), the temperature distribution in the heating nip N with respect to the rotational axis direction is uniformized, so that it is possible to effect the image formation with good quality.

As shown in (a) to (d) of FIG. 12, in a comparative embodiment ((a) and (c) in which the reverse crown shape is not provided and in Embodiment 2(b) and (d)) in which the reverse crown shape is provided, the temperature distribution in the heating nip N with respect to the rotational axis direction in a state in which the operation in the stand-by mode is executed was measured and compared.

As shown in (c) of FIG. 12, in the comparative embodiment in which the spacer 11 is not provided with the reverse crown shape, the distance D becomes larger at the end portions than the central portion with respect to the rotational axis direction in the heating nip N in the bending state of the stay 4 even when the pressure is lowered in the operation in the stand-by mode, so that the temperature lowering is generated.

As shown in (d) of FIG. 12, in Embodiment 2 in which the spacer 11 is provided with the reverse crown shape, when the pressure is lowered in the operation in the stand-by mode, localized heating is effected at the end portions in the heating nip N with respect to the rotational axis direction and therefore the amount of the heating compensates for the amount of heat dissipation at the end portions, so that a uniform temperature distribution is obtained over the entire region.

Embodiment 3

In Embodiment 1, in order to equidistantly provide the exciting coil 6 and the inner magnetic cores 5 over the longitudinal direction, in consideration of the bending of the stay 4 under the pressure application, the spacer 11 was provided with the hyperbola-like reverse crown shape.

However, the amount of the bending of the stay 4 pressed via the fixing flanges 10 and the amount of the bending of the spacer 11, which is not pressed, but is simply attached to the stay 4, do not coincide with each other. Particularly, this is conspicuous at the end portions where the amount of the bending of the stay 4 is large. Therefore, at the longitudinal end portions, the spacer 11 is spaced from the stay 4. This tendency becomes conspicuous in the case where a single spacer is attached to the stay 4 over the longitudinal direction of the stay 4. FIG. 13 is a sectional view showing the fixing film unit and the pressing roller 2. In FIG. 13, when the distance between the exciting coil 6 and the inner magnetic cores at the longitudinal central portion is D5 and the distance between the exciting coil 6 and the inner magnetic cores 5 at the longitudinal end portions is D6, D6<D5 is satisfied, from the fact that the spacer 11 is spaced from the stay 4 at the end portions. The distance D6 between the exciting coil 6 and the inner magnetic cores 5 at the longitudinal central portion becomes smaller than the distance D5 between the exciting coil 6 and the inner magnetic cores 5 at the longitudinal end portions, so that the amount of heat generation at the end portions becomes larger than the amount of heat generation at the central portion (FIG. 14). As a result, the degree of temperature rise at the non-sheet-passing portions generated when a small-sized recording material is continuously passed through the fixing device is liable to become large.

Therefore, this embodiment employs the following constitution.

In this embodiment, a constitution in which each of the end portions of the spacer 11 is elongated and is sandwiched between the fixing flange 10 and the stay 4 (FIG. 15). In this embodiment, the fixing flanges 11 are urged toward the pressing roller 2 by the elastic members and therefore by sandwiching the backborn member (spacer) 11 between the stay 4 and the fixing flanges 11, the bending shape of the spacer 11 approaches that of the stay 4 limitlessly with no spacing of the spacer 11 from the stay 4 at the end portions.

The bending shape of the spacer 11 approaches that of the stay 4 without limit, whereby the distance between the exciting coil 6 and the inner magnetic cores 5 attached to the spacer 11 under the pressure application becomes the same over the longitudinal direction. Further, with respect to the longitudinal direction, the distance between the exciting coil 6 and the inner magnetic cores 5 becomes the same and thus it is possible to uniformize the longitudinal temperature distribution, so that it was possible to achieve a target temperature distribution.

As described above, in this embodiment, the constitution for uniformizing the temperature distribution with respect to the longitudinal direction was explained. However, in addition to the constitution for uniformizing the temperature distribution, in order to achieve the target temperature distribution, the present invention is applicable to even a constitution in which the height of the spacer is changed with respect to the longitudinal direction.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 071783/2011 filed Mar. 29, 2011, which is hereby incorporated by reference.

What is claimed is:

1. An image heating apparatus comprising:

a coil configured to generate magnetic flux;

a belt member configured to generate heat by the magnetic flux, wherein said coil is provided at a position where said coil opposes an outer peripheral surface of said belt member;

a first core and a second core which are provided inside said belt member;

a contact member contacting an inner surface of said belt member along a widthwise direction of said belt member;

a pressing member configured to press said belt member against said contact member to form a nip in which a recording material is nip-conveyed;

a core supporting member configured to support said first core and said second core;

a pressing mechanism configured to generate pressure for forming the nip by using a force generated between said core supporting member and said contact member; and adjusting means, provided on said core supporting member, for adjusting the height of each of said first core and said second core so that the height of a supporting surface configured to support said first core and the height of a supporting surface configured to support said second core are different from each other with respect to a direction perpendicular to the supporting surfaces of the first core and the second core.

2. An image heating apparatus according to claim 1, wherein said first core has a shape identical to that of said second core.

3. An image heating apparatus according to claim 1, wherein said pressing mechanism includes elastic means for urging said contact member toward said pressing member, wherein the height of said adjusting means is set so that the height of the supporting surface supporting said first core provided at an end portion side with respect to the widthwise direction is higher than that of the supporting surface supporting said second core.

4. An image heating apparatus according to claim 1, wherein said adjusting means includes a first adjusting member configured to adjust the height of the supporting surface supporting said first core and a second adjusting member configured to adjust the height of the supporting surface supporting said second core.

5. An image heating apparatus according to claim 1, further comprising a controller configured to control said pressing mechanism so that pressure application in the nip is released during stand-by of a signal for image formation.

* * * * *